US008130165B2

(12) United States Patent
Lindmark

(10) Patent No.: US 8,130,165 B2
(45) Date of Patent: Mar. 6, 2012

(54) PHASE SHIFTER WITH BRANCHED TRANSMISSION LINES HAVING AT LEAST ONE SIDEWAYS MOVABLE DIELECTRIC BODY AND ANTENNA ARRAY FORMED THEREFROM

(75) Inventor: Björn Lindmark, Sollentuna (SE)

(73) Assignee: Powerwave Technologies Sweden AB, Kista (SE)

( * ) Notice: Subject to any disclaimer, the term of this patent is extended or adjusted under 35 U.S.C. 154(b) by 116 days.

(21) Appl. No.: 12/392,029

(22) Filed: Feb. 24, 2009

(65) Prior Publication Data

US 2009/0224848 A1 Sep. 10, 2009

Related U.S. Application Data

(60) Provisional application No. 61/031,322, filed on Feb. 25, 2008.

(51) Int. Cl.
*H01Q 3/32* (2006.01)
*H01P 1/18* (2006.01)

(52) U.S. Cl. ..... 343/853; 333/161; 333/128

(58) Field of Classification Search ..... 333/161, 333/156, 128, 136; 343/853
See application file for complete search history.

(56) References Cited

U.S. PATENT DOCUMENTS

| | | | | |
|---|---|---|---|---|
| 5,467,063 | A * | 11/1995 | Burns et al. | 333/125 |
| 5,905,462 | A * | 5/1999 | Hampel et al. | 342/372 |
| 6,441,700 | B2 * | 8/2002 | Xu | 333/161 |
| 2002/0089394 | A1 * | 7/2002 | McDonald et al. | 333/161 |

FOREIGN PATENT DOCUMENTS

| | | |
|---|---|---|
| JP | 63296402 | 12/1988 |
| WO | 2006/130083 | 12/2006 |

OTHER PUBLICATIONS

International Search Report pertaining to Application No. ITS/SE08/00059 mailed Aug. 6, 2008.

* cited by examiner

*Primary Examiner* — Benny Lee

(74) *Attorney, Agent, or Firm* — OC Patent Law Group

(57) ABSTRACT

There is disclosed an electromagnetic transmission line arrangement with a phase shifter, comprising at least one conductive branch line (51*a*,51*b*) extending from a junction point (51*c*) to an associated output port, for the propagation of electromagnetic signals in a frequency band along said branch line. The phase shifter includes at least one dielectric body (52,53,54) which is mounted so as to be movable sideways in a transverse direction into a delaying position at least partly covering said branch line (51*a*,51*b*). The longitudinal distribution of its dielectric material (∈) is adapted to cause, when being moved transversally into said delay position, a controlled phase shift but also to secure, by way of said selected longitudinal distribution of its dielectric material in conjunction with said at least one branch line, an input impedance matching of said transmission line arrangement. The transmission line arrangement can be used in the feeding network to a microwave antenna.

13 Claims, 8 Drawing Sheets

PHASE SHIFTER WITH BRANCHED TRANSMISSION LINES HAVING AT LEAST ONE SIDEWAYS MOVABLE DIELECTRIC BODY AND ANTENNA ARRAY FORMED THEREFROM

RELATED APPLICATION INFORMATION

The present application claims the benefit under 35 U.S.C. §119(e) of the priority date of U.S. Provisional Patent Application Ser. No. 61/031,322 filed Feb. 25, 2008, the entire contents of which are hereby expressly incorporated by reference.

FIELD OF THE INVENTION

The present invention relates to an electromagnetic transmission line arrangement with a phase shifter, e.g., for use in a microwave antenna. The transmission line arrangement comprises at least one branch line extending from a junction point to an associated output port, for the propagation of electromagnetic signals in a frequency band, e.g. in the frequency region 0.5 to 10 GHz, along said branch line. The frequency band may have a relative band width of 10-50%. At least one ground plane is located in parallel with but at a distance from the planar transmission line arrangement. The phase shifter includes at least one dielectric body being movably mounted in a space between the ground plane and the transmission line arrangement and is movable in the space so as to achieve a variable phase shift and a controlled delay of the electromagnetic signals in the frequency band at the output port.

BACKGROUND OF THE INVENTION

Prior Art

Such transmission line arrangements are well-known and are used frequently in microwave antennas, e.g. for cellular telephone systems. In prior art devices of this kind, the phase shifter often includes a dielectric body which is movable longitudinally relative to a branch line. In this way, a desired phase shift and delay of the signal is achieved, so that the signal being radiated with a delay from an associated antenna element, in conjunction with signals emitted from other antenna elements, will cause a change in the electromagnetic composite beam. So, by moving the dielectric body longitudinally, it is possible to change the direction of the beam, e.g. in elevation, so called "electrical down tilt".

Normally, a feed line extends to a junction point, and from there two branch lines extend in opposite directions. The dielectric body covers a part of the feed line and the oppositely directed branch lines and is movable longitudinally in parallel to the two branch lines. When the dielectric body, which is relatively long (much longer than its width), is longitudinally displaced, the signal will be further delayed in one branch line and less delayed in the other branch line, causing the associated antenna elements to emit signals with a different delay, so that the emitted wave changes its main direction. Several such feed line portions can be arranged in parallel to each other, possibly in a meander-like pattern, for feeding a desired number of antenna elements.

An example of such a transmission line arrangement is disclosed in the document WO 2006/130083 A1.

Another prior art transmission line arrangement is disclosed in JP 63 296 402, where a tapered dielectric body is movable at right angle to a transmission line. The dielectric body has the shape of a triangle, with a corner point in the direction of movement. The base of the triangle is relatively short, so the tapered body has an effective width (in the longitudinal direction of the transmission line) approximately corresponding to the width of the transmission line. With such a very short dielectric body, the resulting signal delay will be very small, and it will be difficult to avoid a reflection due to the lack of measures for input impedance matching.

OBJECT OF THE INVENTION

Now, there is a desire to provide a change of the emitted microwave beam in azimuth as well, i.e. sideways relative to a central horizontal direction from the antenna. Of course, such a change can be brought about by rotating the whole antenna mechanically, or by changing the directions of all or some of the antenna elements. However, this is complicated and very expensive.

Accordingly, there is a need for an additional cost-effective way to change the phase and possibly also the amplitude of the electromagnetic signals propagating in the transmission line arrangement of the antenna. In particular, there is a need for a transmission line arrangement with branch lines extending from a junction point to different vertical columns of antenna elements, so as to make it possible to change the delay of the signals transferred to one column in relation to the signals transferred to another column.

Theoretically, it might be possible to arrange a number of similar or identical transmission arrangements according to prior art, coupled in series, one of them being used for elevation phase control and another one being used for azimuth control. However, such an arrangement would be unduly complicated and expensive.

SUMMARY OF THE INVENTION

A main object of the present invention is to provide a cost-effective transmission line arrangement, where the phase shift adjustment can be effected in a more favorable manner and the overall structure is relatively simple. This is achieved in that the longitudinally extending dielectric body being longer than $\lambda/4$ ($\lambda$ being the wavelength of the electromagnetic wave propagating along the branch line in the absence of any dielectric material), is movable sideways relative to said branch line into a delaying position at least partly covering said branch line along its full length, and in that the dielectric body has a longitudinal distribution of its dielectric material being adapted to cause, upon being moved sideways into said delaying position, a controlled phase shift but also to secure, in conjunction with said at least one branch line, an input impedance matching of the transmission line arrangement.

The invention will provide numerous possibilities for an antenna designer to arrange one or more conductive branch lines extending from a junction point, e.g. in a fork-like pattern in parallel to each other or in some other configuration, and to control the signal phase and delay of the signal in each branch line so as to provide a desired beam pattern from antenna elements coupled to the various branch lines.

As will be apparent below, there are many different embodiments of the dielectric body or bodies which can be used in accordance with the invention, and some of these embodiments are very favorable from a design and production point of view.

The invention will now be explained further with reference to the attached drawings which illustrate some preferred embodiments.

DETAILED DESCRIPTION OF PREFERRED EMBODIMENTS

Figure 1:
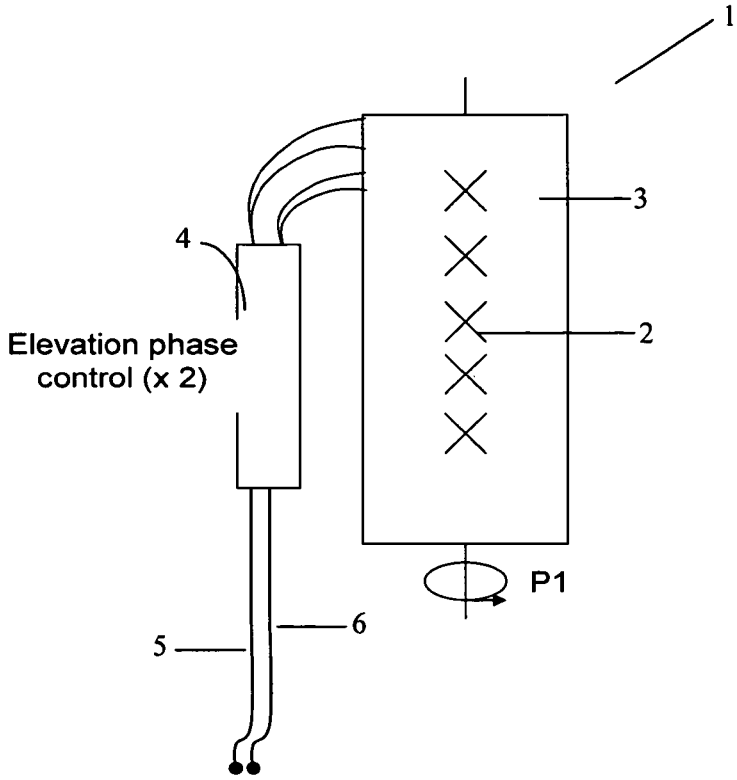
Fig. 1 (Prior Art)
FIG. 1 illustrates schematically a prior art antenna, provided with a transmission line arrangement, which will enable an adjustment of the elevation angle of a beam emitted from the antenna, by way of shifting a dielectric body in the longitudinal direction.

In the microwave antenna 1 shown schematically in FIG. 1, according to prior art, there is a vertical column with five individual antenna elements 2 mounted in a linear array on a substantially planar reflector 3. When being fed with microwave power from a source (not shown) via a feed structure in a control unit 4 (denoted "elevation phase control" to the left in FIG. 1), the antenna will be able to emit and receive electromagnetic signals in a well-defined beam, e.g. between a base station and mobile telephones in a cellular mobile telephone system.

If desired, the whole antenna can be mechanically rotated, as indicated by the rotational arrow P1, but this aspect is of no concern in relation to the present invention.

The electromagnetic beam from the antenna 1 can be steered in elevation, namely in a vertical plane through the column of antenna elements 2, by way of an adjustable electric power divider feeding the various antenna elements. The control unit 4 has two input feed lines 5,6, one for each polarization (each antenna element is cross-polarized as is known in the art). Within the control unit 4, the power is divided into five signals being identical in terms of frequency contents but being shifted in phase in relation to each other (for each polarization, denoted "(×2)" in FIG. 1). Hereby, some signals will be delayed more than others, and it is possible to obtain a beam which is tilted more or less in the vertical plane, so called "electrical down tilt".

Figure 2:
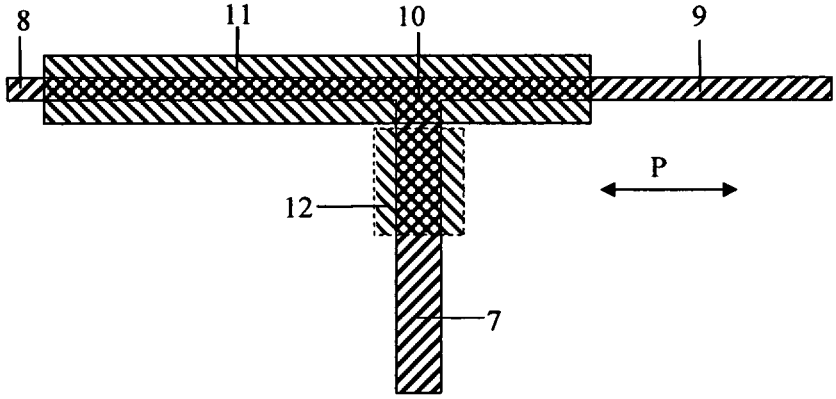
Fig. 2 (Prior Art)
FIG. 2 shows schematically the prior art transmission line arrangement associated with the antenna shown in FIG. 1.

FIG. 2 shows a previously known way to achieve such a controlled phase shift and signal delay, by means of a prior art branch line arrangement with an input transmission line 7 oriented at right angle to two output transmission lines 8,9 essentially consisting of a metal strip material and being arranged in parallel to a ground plane (not shown), so that the electromagnetic signals can propagate from the input transmission line 7 and, upon being divided equally at the junction point 10, further along each of the output transmission lines 8,9. One, two or more such power dividers can be coupled in series so as to obtain a desired division of power and delay of the propagated signal.

The delay is achieved by arranging a dielectric body 11 along the two output transmission lines 8,9, and also a dielectric body portion 12 along a portion of the input transmission line 7. The propagation velocity of the electromagnetic signal is dependent on the dielectric constant of the material in the volume where the electromagnetic wave propagates. In order to adjust the velocity, and consequently the delay at the output terminals of the output transmission lines 8,9, the dielectric body 11 is displaced back and forth in a controlled way longitudinally along the lines 8,9, in the direction of the arrow P. Thus, the relative velocities will change, and so will the respective delay. In practice, the shape and configuration of the dielectric body are adapted to the particular antenna design, also taking into account the need for impedance matching in order to avoid reflection of the signal. In this way, the vertical inclination or tilt of the beam can be controlled to a certain extent.

Now, as indicated above, there is a need for additional beam adjustment, especially in azimuth. For this purpose, a novel transmission line arrangement has been developed, in accordance with the present invention.

Figure 3:
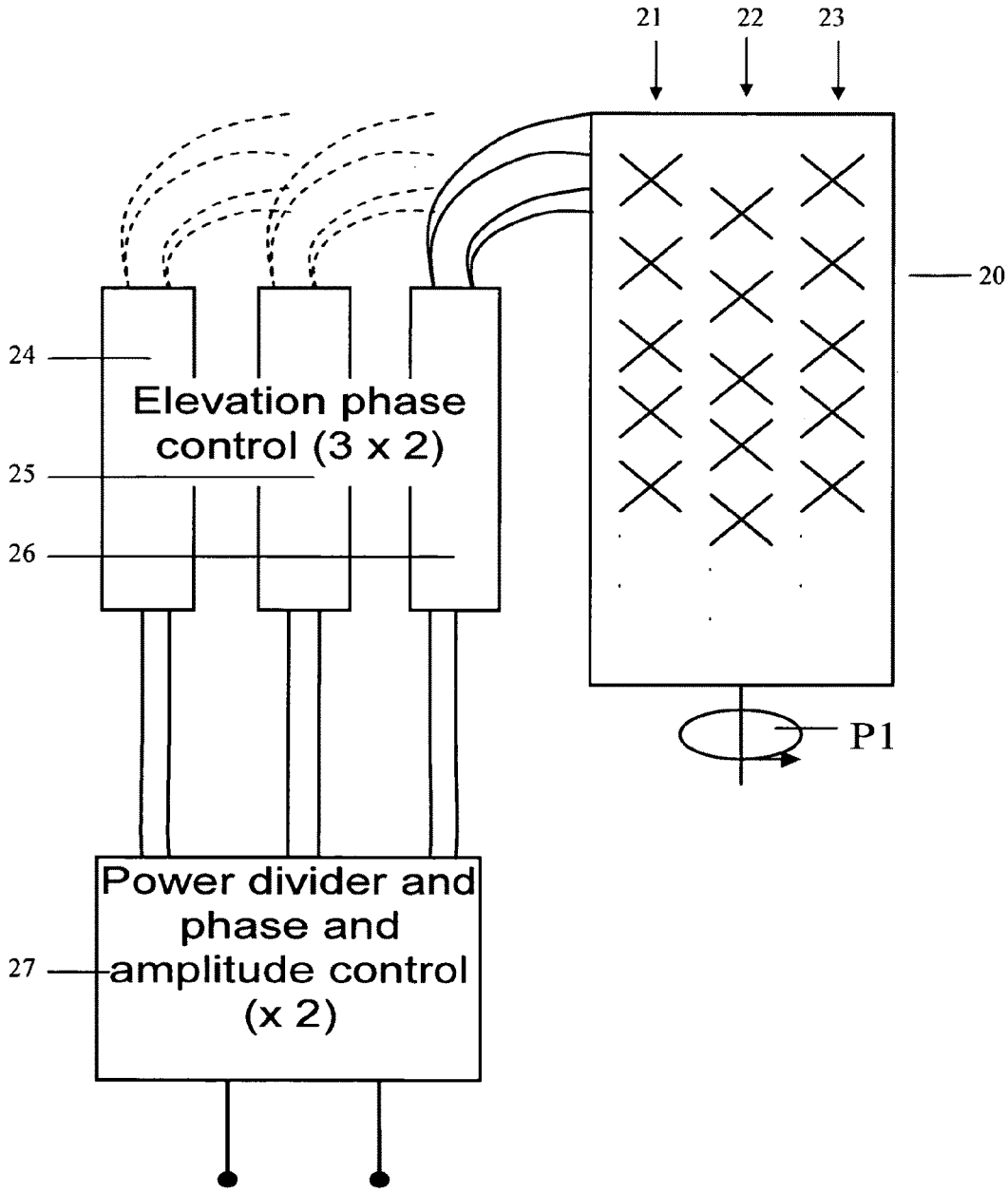
FIG. 3 shows schematically an antenna provided with a trans-mission line arrangement according to the invention, the latter arrangement being shown as a schematic box-like unit, enabling an adjustment of the azimuth direction and/or azimuth beam width.

In FIG. 3, there is shown an antenna with three vertical columns of antenna elements 21,22,23. Each such column is adjustable by associated control units 24,25,26 of the kind described above (for each of two polarizations, denoted "(3×2)" in FIG. 3). So, the elevation of the composite electromagnetic beam from the antenna can be controlled by these control units. Like in FIG. 1, the whole antenna 20 can possibly be rotated mechanically (arrow P1), but this aspect is not a part of the present invention.

In series with these control units, preferably at the input side to reduce the necessary hardware, there is a new kind of control unit 27, denoted "power divider and phase and amplitude control", serving to control the antenna beam in azimuth (for each of two polarizations, denoted "(×2)" in FIG. 3). The control can be performed in terms of the main direction and/or the width of the beam.

The basic feature of the present invention is the arrangement of a transmission line (or lines) in conjunction with a dielectric body (or body segments, separate body portions or bodies) being movable sideways in a transverse direction in relation to the transmission line. A number of embodiments of such an arrangement will now be described with reference to the drawing FIGS. 4*a*, 4*b*, 5*a*, 5*b*, 5*c*, 6*a*, 6*b*, 7*a*, and 7*b*.

Figure 4A:
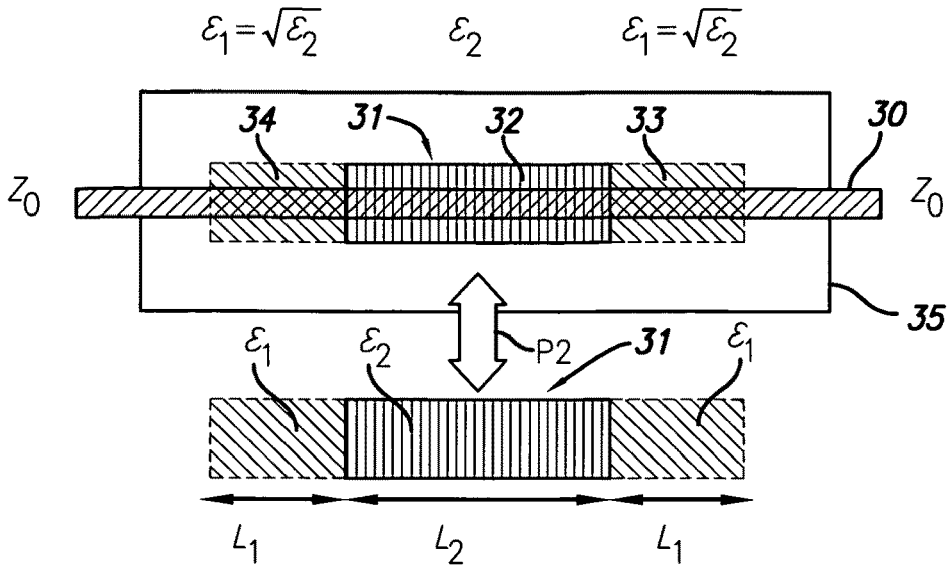
FIGS. 4*a* and 4*b* show schematically two embodiments of a trans-mission line arrangement according to the invention, with a single transmission line extending between two ports.

In FIG. 4*a*, there is shown a single transmission line 30, an underlying ground plane 35 (schematically indicated), and a longitudinal dielectric body 31 with three different segments, namely a central segment 32 and two end segments 33,34. The dielectric body is movable in its entirety in the transversal direction, indicated by the arrow P2, and can be displaced between a neutral or inactive position (below in FIG. 4*a*), where it does not influence the velocity of the propagating wave and an active position, or "delaying position", where it causes a corresponding delay of the signal propagating along the associated branch line 30. By such an arrangement with a transversely movable dielectric body, there are many possible ways of configuring a particular transmission line arrangement, having one, two, three or even more transmission lines extending from a junction point.

In order to avoid a loss of power being transferred, the input impedance, e.g. at the left end of the transmission line in FIG. 4*a*, must be matched when the dielectric body is positioned in its active position. One way of doing this is to use a quarter-wave-matching where each of the end segments 33,34 has a dielectric constant $\in_1$ and the central section has a dielectric constant $\in_2$, the matching being achieved in that $$\in_1=\sqrt{\in_2}$$

$$L1=\lambda/(4\sqrt{\in_1})=\lambda/(4\sqrt{\sqrt{\in_2}}),$$

L1 being the physical length of each end segment 33,34 and λ being the wave-length in air. Of course, instead of such an adaption of the electric dielectric constant, it is also possible to change the geometrical configuration of the respective segment, e.g. by varying the width (thickness), or by drilling holes through the dielectric material. The skilled artisan can therefore ensure that the impedance seen from both ends (in the longitudinal direction) of the dielectric body matches the characteristic impedance $Z_0$ of the transmission line. This match will be obtainable for a specific frequency only. However, within a relatively narrow frequency band, it is not necessary to take this in consideration.

The main purpose of the transversely movable dielectric body 31 is to bring about a predetermined delay of the signal, and this can be achieved by properly selecting the length L2 of the central body 32. This can also be done by the skilled artisan.

Figure 4B:
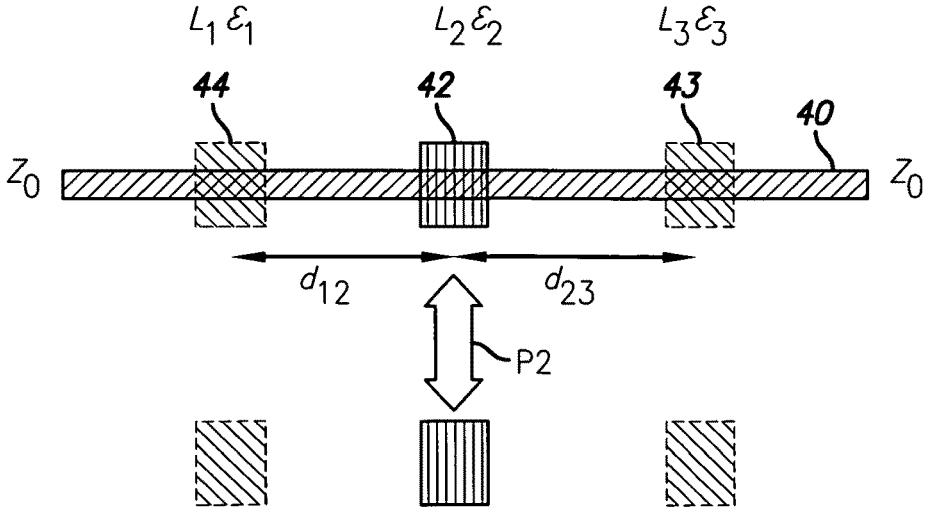

Instead of an integrated dielectric body with unitary end segments, it is also possible to use separate body portions as shown in FIG. 4*b*. Here, a central portion 42 corresponds to the central section in FIG. 4*a*, having length $L_2$ and dielectric constant $\in_2$, and the left and right body portions, 44, 43 correspond to the end segments in FIG. 4*a* and have respective lengths $L_1$, $L_3$ and dielectric constants $\in_1$, $\in_3$. Left and right body portions 44, 43 have spacing $d_{12}$ and $d_{23}$ respectively, from central portion 42 and $Z_0$ denotes the characteristic impedance of the transmission line 40.

It has turned out that an arrangement according to FIG. 4*b* operates much like the arrangement of FIG. 4*a*. All three body portions have to be movable sideways, preferably in synchronism, in the transverse direction (arrow P2).

In principle, a transmission line with one dielectric body, or with a number of separate body portions all being movable sideways in the transverse direction, can bring about a desired delay so as to cause e.g. a change of the beam in azimuth. If two of the vertical columns are fed with power through feed lines having only a phase delay causing a down tilt, and the third vertical column, e.g. the central one, is additionally delayed somewhat, the width of the beam will be smaller. Such a transmission line arrangement can be integrated in a prior art arrangement, where a transversely movable dielectric body is integrated in each part of the control unit 4 in FIG. 1 (which also includes longitudinally movable dielectric bodies).

However, normally, in an antenna with two or more vertical columns of antenna elements, it will be more practical to have a separate control unit 27 in series, as illustrated in FIG. 3. In such a control unit, there is a junction point for each polarization (two junction points) with parallel transmission lines extending in parallel therefrom, typically two or three such lines from each junction point. These transmission lines are then coupled pair-wise to the respective elevation phase control (3×2) units 24,25,26 (FIG. 3).

In a transmission line arrangement with two parallel transmission lines, the input power may be divided equally at the junction point, or unequally.

Figure 5A:
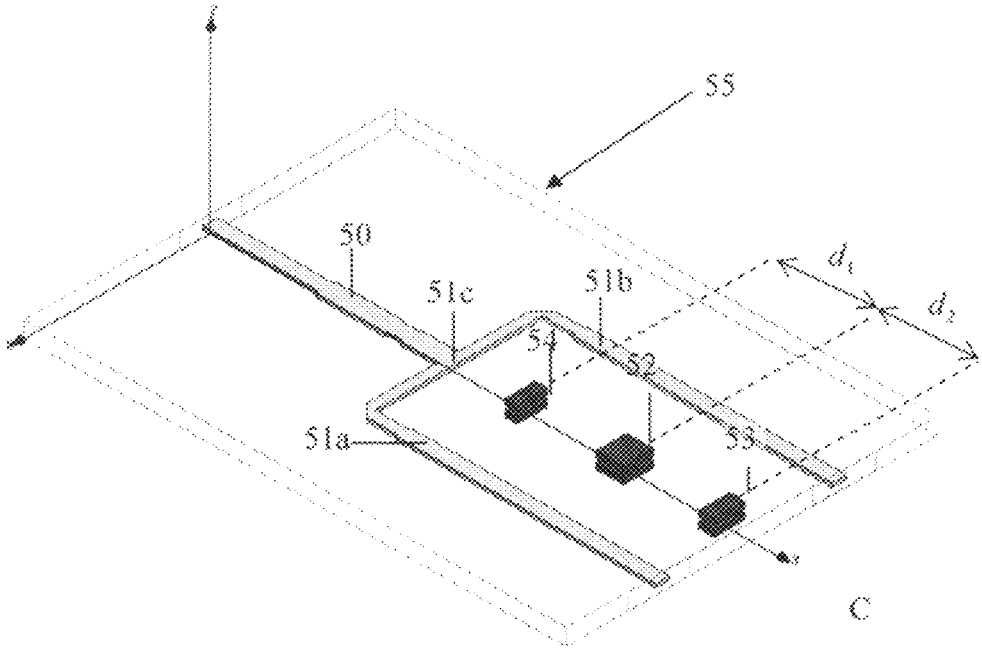
FIGS. 5*a* and 5*b* show an equal power divider, with two parallel transmission lines and three separate body portions constituting a dielectric body, being movable sideways between the two transmission lines and a neutral position therebetween.
Figure 5B:
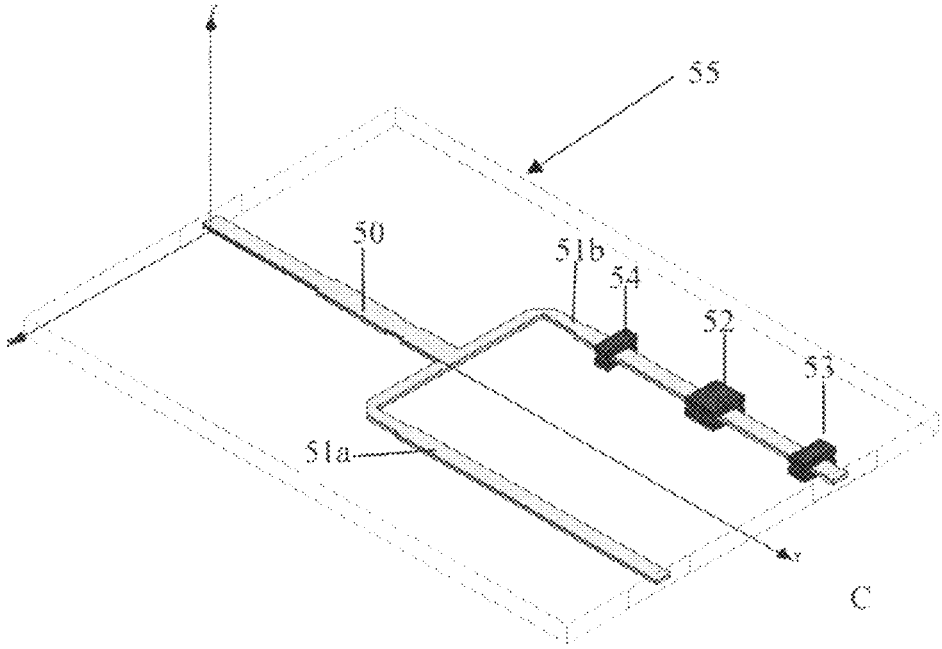

An equal-power divider in strip line is shown in FIGS. 5*a* and 5*b*. An input conductive feed line 50 is divided into two equal conductive branch lines 51*a*,51*b* extending in a fork-like manner from a junction point 51*c* as shown in FIG. 5*a*.

The power divider is accommodated in a box-like, relatively flat casing 55 with metallic upper and lower walls (or coatings) serving as ground planes. (Rectangular coordinates X, Y, Z are shown for reference in FIGS. 5*a*, 5*b*, 6*a*, 6*b* and 6*c*.)

In FIG. 5*a*, there are three separate dielectric body portions 52,53,54 located in a neutral position on a straight (imaginary) line C centrally between the branch lines (with spacing $d_1$, $d_2$ between body portions 54, 53 from body portion 52). These body portions may correspond to the portions 32,33,34 shown in FIG. 4*b*. In this position, the power is divided equally into the two branch lines 51*a*,51*b*. Each branch line has narrow and wider sections adapted to provide for impedance matching at the input, so that there will be only a minor reflection of the input wave. As indicated in FIGS. 5*a* and 5*b*, each dielectric body is divided into two parts, one upper part and one lower part.

In the shown example, for a frequency band 1710 MHz-2170 MHz the particulars are the following:

| | Length/distance (mm) | dielectric constant (ϵ) |
|---|---|---|
| Body portion 52: | 9 | 3 |
| Body portion 53: | 5 | 3 |
| Body portion 54: | 4 | 3 |
| Distance $d_1$ | 32 | |
| Distance $d_2$ | 31.5 | |

In FIG. 5*b*, the three separate dielectric body portions 52,53,54 have been displaced sideways or transversally (in relation to the imaginary central line C) so as to cover one (51*b*) of the branch lines. In this way, the signal on the branch line 51*b* will be delayed, as explained above with reference to FIGS. 4*a* and 4*b*. There is some input reflection, but the amount is almost negligible, provided that the dielectric constants and the lengths of the body portions are adequately selected, as in the example given above.

Figure 6A:
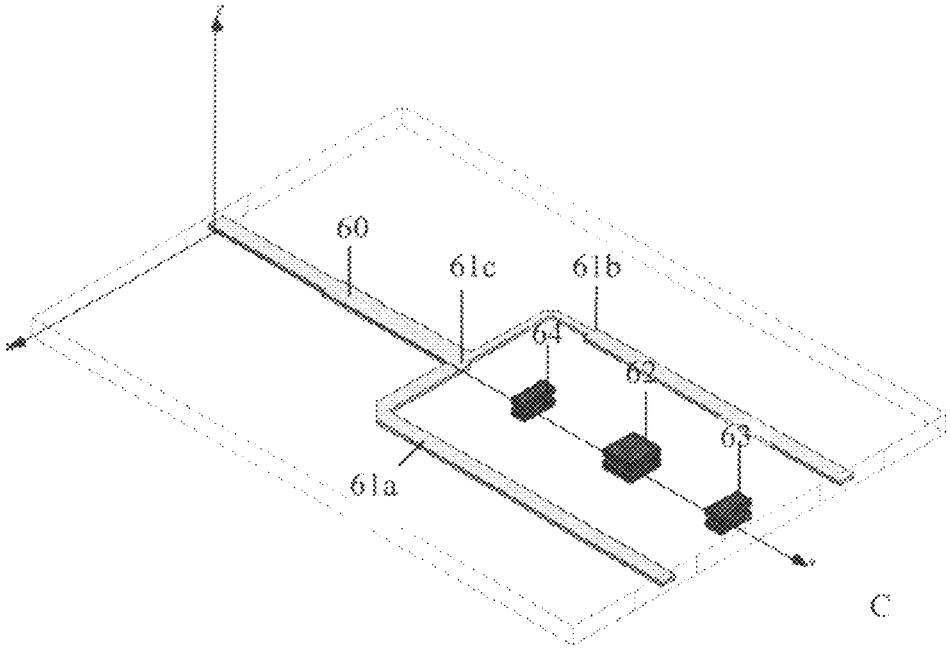
FIGS. 6*a*, 6*b* and 6*c* show an unequal power divider, with two parallel transmission lines and three separate body portions of a dielectric body, being movable sideways between the two transmission lines and a neutral position therebetween.
Figure 6B:
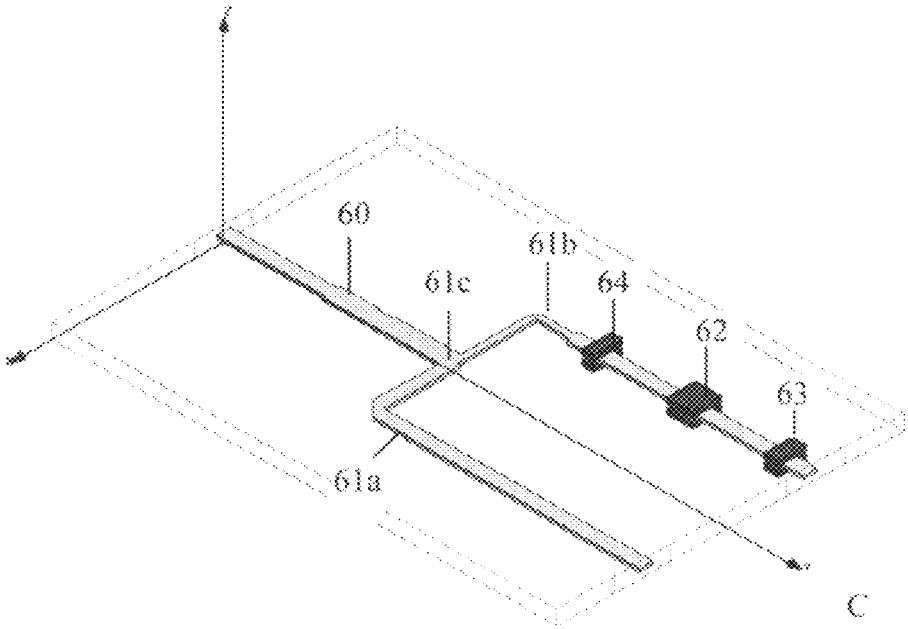
Figure 6C:
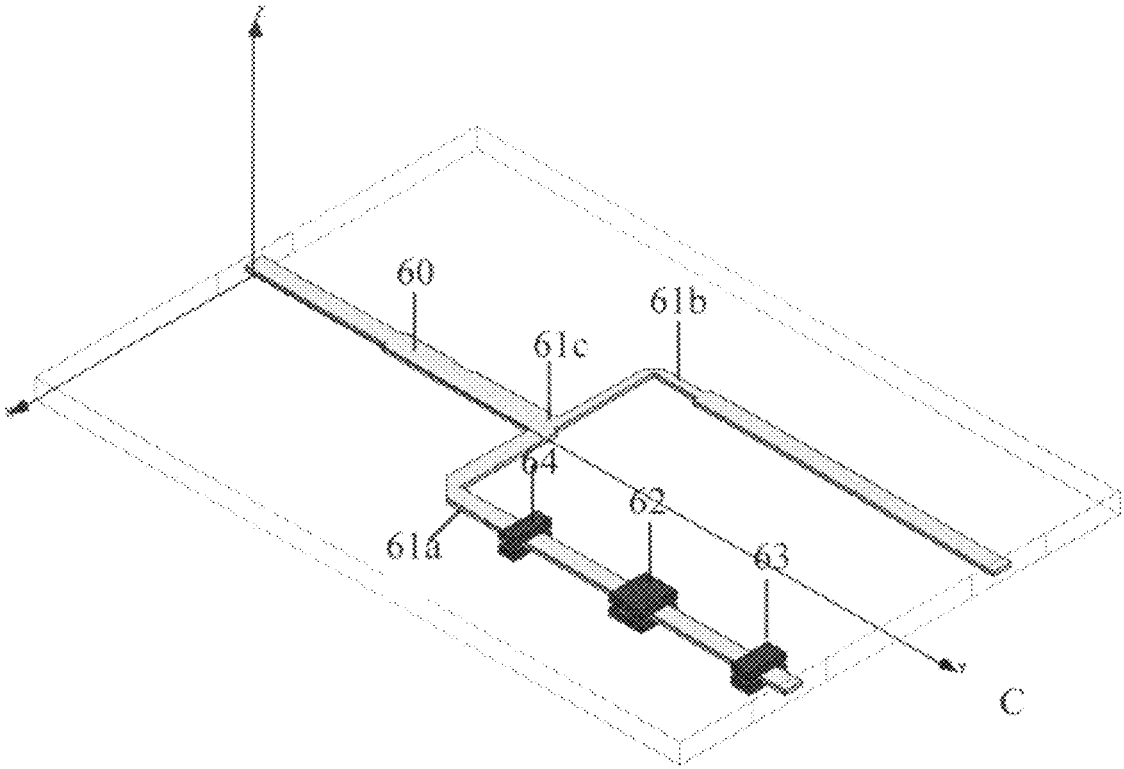

In FIGS. 6*a*,6*b*,6*c* there is shown an embodiment with an unequal-power divider similar to the divider shown in FIGS. 5*a* and 5*b*, (with a similar imaginary central line C) but with two branch lines 61*a* and 61*b* extending from a feed line 60 having a junction point 61*c* and being designed for providing a power ratio of 3 dB between the branch lines. For this purpose, the conductive branch line 61*b* has a portion with a smaller width adjacent to the junction point. There are three dielectric body portions 62,63,64 (each with upper and lower parts) similar to the ones shown in FIGS. 5*a* and 5*b*, which are movable transversely or sideways into a position shown in FIG. 6*b* or into a position shown in FIG. 6*c*, covering the branch line 61*b* or 61*a*, respectively.

In the position shown in FIG. 6*b*, the signal in branch line 61*b* will be delayed, whereas in the position shown in FIG. 6*c*, the signal in the other branch line 61*a* will be delayed. Because of the thinner (less wide) branch line 61*b*, there will be a slight imbalance in the phase at the two ports in the neutral position (FIG. 6*a*), but the power ratio will nevertheless be substantially the same, about 3 dB.

Figure 7A:
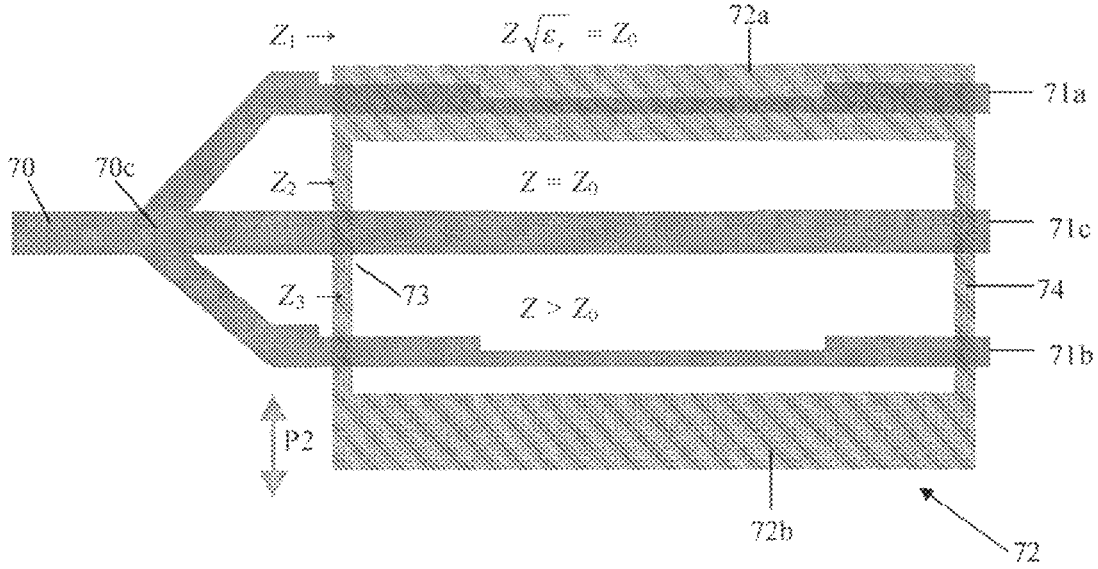
FIGS. 7*a*, 7*b* and 7*c* show schematically three embodiments of a transmission line arrangement according to the invention for three branch lines extending in parallel to each other from a junction point.
Figure 7B:
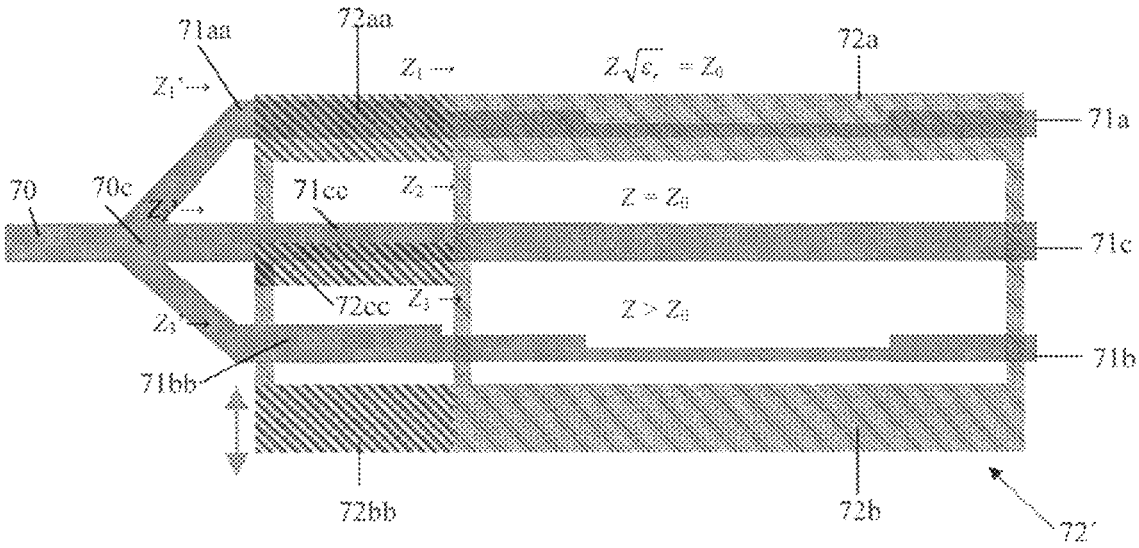
Figure 7C:
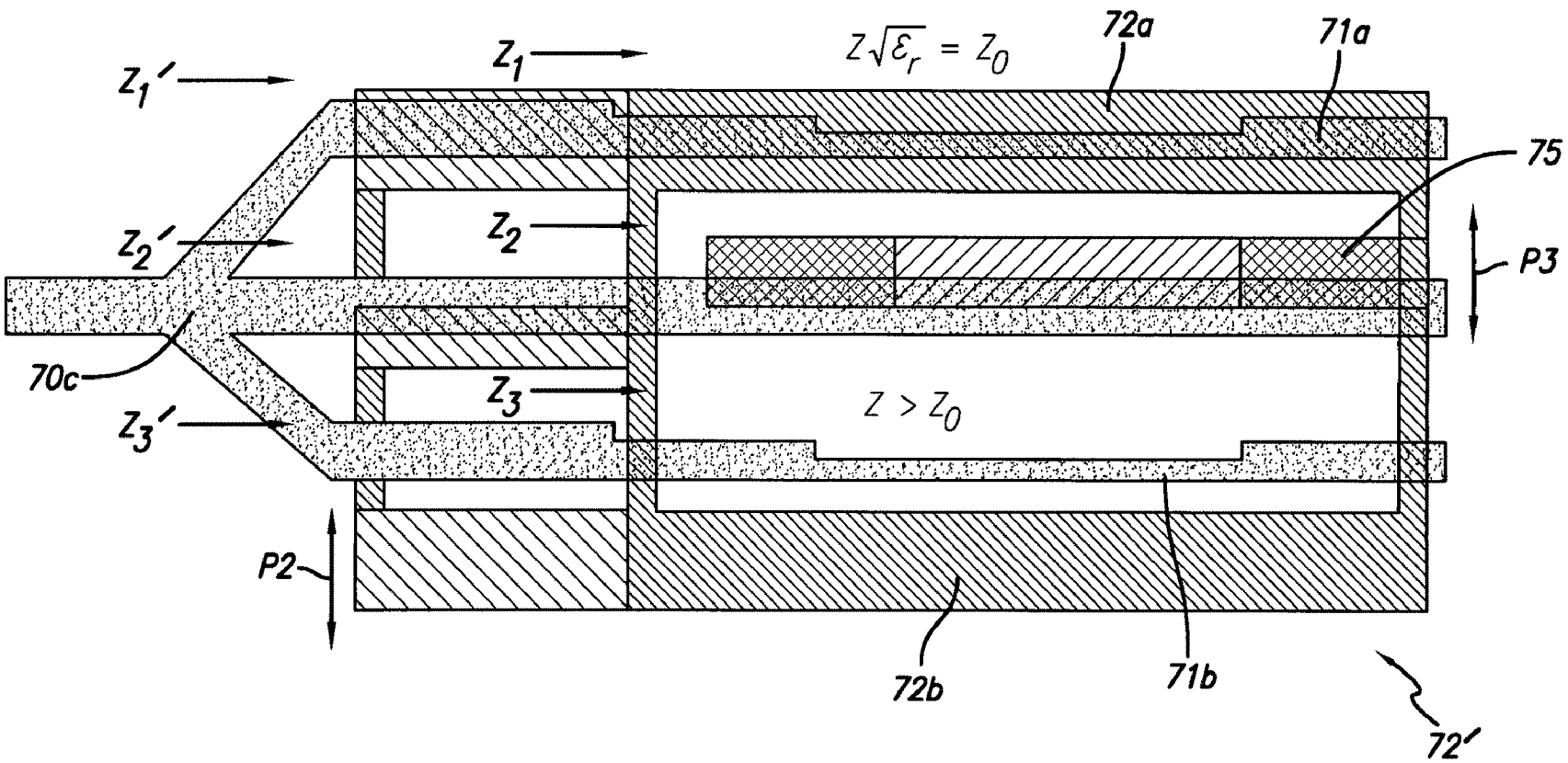

Embodiments with three branch lines are shown in FIGS. 7*a*, 7*b* and 7*c*.

In FIG. 7*a*, the three conductive branch lines are denoted 71*a*,71*b*,71*c* and have input impedances $Z_1$, $Z_2$, $Z_3$, respectively, and extend from a feed line 70 with a junction point 70*c*. The upper and lower (or first and second) branch lines 71*a* and 71*b* have sections with a step-wise reduced width, whereby the impedance Z will be higher and the power being fed along these two lines will be less than in the central line 71*c*, in the absence of any dielectric bodies being positioned onto the lines. However, a specially designed dielectric body 72 is arranged so as to enable a shift in the relative delay of the signal being transmitted through the lines 71*a*, 71*b*. The dielectric body is made as one integrated body 72 having an upper or first rectangular body part 72*a*, with a longitudinal extension corresponding substantially to the straight portion of the upper or first branch line 71*a*, and a lower or second rectangular body part 72*b*, with a longitudinal extension corresponding to the straight portion of the lower or second branch line 71*b*, and two relatively thin transverse portions 73 and 74 connecting the two body parts 72*a* and 72*b* at their ends. The length of these transverse portions is greater (or smaller) than the distance between the branch lines 72*a*,72*b*, so that only one (72*a* or 72*b*) of the body parts will cover an associated branch line 71*a*,71*b* at a time.

As indicated in FIG. 7*a*, the dielectric constant $\in_r$ of the body portion 72*a* is selected so that the impedance of the branch line 71*a*, with the body part 72*a* covering the body part 71*a*, is the same as the impedance $Z_0$ of the central branch line 71*c* without any covering dielectric material. Also, the step-wise reduction of the widths of the lines 71*a* and 71*b* is such that all three branches will have the same input impedance all the time, irrespective of the position of the integrated dielectric body, either with the body part 72*a* covering the branch line 71*a* or with the body part 72*b* covering the branch line 71*b* (upon a transversal movement in the direction of the arrow P2).

Of course, this transmission line arrangement can be used, e.g., in a control unit 27 in order to delay the signal in one of the edge columns 21,23 in FIG. 3. Since the input impedance of the three branch lines is the same, the power will at all times be equally divided between the lines.

In case it is desirable to control the power distribution between the three lines, an embodiment as shown in FIG. 7*b* can be used. Here, the structure is the same as in FIG. 7*a*, and common reference numerals are used, except that the branch lines and the dielectric body is longitudinally extended, with branch line extensions 71*aa*, 71*bb* and 71*cc*, and dielectric body part extensions 72*aa*, 72*bb* as well as an extra body part 72*cc* partially covering the branch line extension 71*cc*. The structure is such that the input impedance $Z_1'$, $Z_2'$, $Z_3'$ (at the input or left end of the three branch lines) will depend on the transversal position of the integrated dielectric body 72'. The extensions 72*aa*,72*bb*,72*cc* have a selected length and dielectric constant.

In the illustrated position of the dielectric body 72', the input impedance of the lower or second branch line 71*bb* is higher than that of the two other branch line, so the power transferred along the lower or second branch line will be lower. It will be appreciated that the relative power at the edge columns (of the antenna 20 in FIG. 3) can be adjusted, so that the beam is adjusted to a certain extent in azimuth.

In the embodiment illustrated in FIG. 7*c*, the structure is like the one shown in FIG. 7*b*, and common reference numerals are used, but there is an additional dielectric body 75 arranged in parallel to the central branch line and being movable in the transverse direction (arrow P3). Hereby the signal to the centre column of the antenna 20 in FIG. 3 can be delayed so as to reduce the width of beam being emitted from the antenna 20.

The skilled artisan can use the teachings in this disclosure, within the scope of the claims, e.g. by modifying the direction of the "transverse" movement of the dielectric body. Thus, this movement can also be performed at an angle (less than 90 degrees, and preferably less than 45 degrees) to the perpendicular transverse direction.

In the delaying position, the dielectric body (or its separate portions) should be oriented longitudinally along the associated transmission line. However, the movement towards and away from this position can be performed in various ways, even in a swinging movement about a fixed (or movable) axis.

Also, the transmission line arrangement can be somewhat curved rather than exactly planar.

Moreover, it is of course possible to use the novel transmission line arrangement for other purposes, e.g., for steering a beam in elevation rather than in azimuth.

The invention claimed is:

1. An electromagnetic transmission line arrangement with a phase shifter, comprising at least one conductive branch line extending from a junction point to an associated output port, for the propagation of electromagnetic signals in a high frequency band along said at least one branch line, at least one ground plane being located in parallel with but at a distance from said transmission line arrangement, said phase shifter including at least one dielectric body being movably mounted in a space between said ground plane and said at least one branch line and being movable in said space so as to achieve a variable phase shift and a controlled delay of said electromagnetic signals when propagating along said at least one branch line, said at least one dielectric body having a longitudinal extension between ends thereof which is longer than the width thereof and also longer than $\lambda/4$, $\lambda$ being the wavelength of the electromagnetic wave propagating along said at least one branch line in the absence of any dielectric material, wherein said at least one longitudinally extending dielectric body is movable sideways in relation to said at least one branch line into a delaying position, where said at least one dielectric body at least partly covers and is parallel to said at least one branch line along the full length of said dielectric body, said at least one dielectric body has a selected, longitudinal distribution of dielectric material being adapted to cause, upon being moved sideways into said delaying position, a controlled phase shift but also to secure, by way of said selected longitudinal distribution of said dielectric material in conjunction with said at least one branch line, an input impedance matching of said transmission line arrangement, and wherein said at least one dielectric body is movable sideway between a neutral position having no influence on the signal propagating along said branch line, and said delaying position.

2. An electromagnetic transmission line arrangement as defined in claim 1, wherein said at least one dielectric body comprises at least three separate dielectric body portions distributed along said at least one branch line, said at least three separate dielectric body portions comprising a central body portion having a length adapted to cause a desired signal delay and two end body portions each having a length and a dielectric constant providing, in conjunction with said at least one branch line, said impedance matching.

3. An electromagnetic transmission line arrangement as defined in claim 2, wherein said at least three separate dielectric body portions are movable sideways in synchronism into said delaying position.

4. An electromagnetic transmission line arrangement as defined in claim 2, wherein said at least three separate dielectric body portions are displaceable sideways between at least two delaying positions, each of said at least three separate dielectric body portions covering an associated branch line extending from said junction point to an associated output port.

5. An electromagnetic transmission line arrangement as defined in claim 1, wherein said at least one dielectric body comprises an integrated body with at least one central segment having a length adapted to cause a desired signal delay and two end segments each of said end segments having a length and a dielectric constant providing said impedance matching.

6. An electromagnetic transmission line arrangement as defined in claim 1, wherein said at least one dielectric body comprises at least two parallel body parts, each being located in the vicinity of an associated branch line extending from said junction point to an associated output port and being displaceable sideways, by a movement of said at least one dielectric body, between a delaying position for a first body part in relation to a first branch line, with a second body part being situated in a first neutral position, and a second neutral position for said first body part, with said second body part being situated in a delaying position in relation to a second branch line.

7. An electromagnetic transmission line arrangement as defined in claim 6, wherein said at least two parallel body parts each includes an extension with a selected dielectric constant.

8. An electromagnetic transmission line arrangement as defined in claim 1, wherein said at least one conductive branch line comprises at least two parallel branch lines extending from said junction point, wherein said at least two parallel branch lines have different input impedance so as to bring about an unequal power division between said at least two parallel branch lines.

9. An electromagnetic transmission line arrangement as defined in claim 8, wherein said at least one dielectric body is configured so as to retain said unequal power division when being moved sideways into a respective delaying position.

10. An electromagnetic transmission line arrangement as defined in claim 1, wherein said sideways movement is performed in a transverse direction in relation to said at least one branch line.

11. An antenna having at least one column of antenna elements, including an electromagnetic transmission line arrangement as defined in claim 1, wherein said at least one branch line is connected to said at least one column of antenna elements.

12. An electromagnetic transmission line arrangement with a phase shifter, comprising at least one conductive branch line extending from a junction point to an associated output port, for the propagation of electromagnetic signals in a high frequency band along said at least one branch line, at least one ground plane being located in parallel with but at a distance from said transmission line arrangement, said phase shifter including at least one dielectric body being movably mounted in a space between said ground plane and said at least one branch line and being movable in said space so as to achieve a variable phase shift and a controlled delay of said electromagnetic signals when propagating along said at least one branch line, said at least one dielectric body having a longitudinal extension between ends thereof which is longer than the width thereof and also longer than $\lambda/4$, $\lambda$ being the wavelength of the electromagnetic wave propagating along said at least one branch line in the absence of any dielectric material, wherein said at least one longitudinally extending dielectric body is movable sideways in relation to said at least one branch line into a delaying position, where said at least one dielectric body at least partly covers and is parallel to said at least one branch line along the full length of said dielectric body, said at least one dielectric body has a selected, longitudinal distribution of dielectric material being adapted to cause, upon being moved sideways into said delaying position, a controlled phase shift but also to secure, by way of said selected longitudinal distribution of said dielectric material in conjunction with said at least one branch line, an input impedance matching of said transmission line arrangement, wherein said at least one conductive branch line comprises at least two parallel branch lines extending from said junction point, wherein said at least two parallel branch lines have different input impedance so as to bring about an unequal power division between said at least two parallel branch lines, and wherein said at least one dielectric body is configured so as to change said unequal power division when being moved sideways.

13. An antenna, including an electromagnetic transmission line arrangement with a phase shifter, comprising at least one conductive branch line extending from a junction point to an associated output port, for the propagation of electromagnetic signals in a high frequency band along said at least one branch line, at least one ground plane being located in parallel with but at a distance from said transmission line arrangement, said phase shifter including at least one dielectric body being movably mounted in a space between said ground plane and said at least one branch line and being movable in said space so as to achieve a variable phase shift and a controlled delay of said electromagnetic signals when propagating along said at least one branch line, said at least one dielectric body having a longitudinal extension between ends thereof which is longer than the width thereof and also longer than $\lambda/4$, $\lambda$ being the wavelength of the electromagnetic wave propagating along said at least one branch line in the absence of any dielectric material, wherein said at least one longitudinally extending dielectric body is movable sideways in relation to said at least one branch line into a delaying position, where said at least one dielectric body at least partly covers and is parallel to said at least one branch line along the full length of said dielectric body, said at least one dielectric body has a selected, longitudinal distribution of dielectric material being adapted to cause, upon being moved sideways into said delaying position, a controlled phase shift but also to secure, by way of said selected longitudinal distribution of said dielectric material in conjunction with said at least one branch line, an input impedance matching of said transmission line arrangement, said antenna including at least two columns of antenna elements, said at least two columns of antenna elements being substantially vertical columns of antenna elements emitting and receiving a composite microwave beam, wherein said at least one branch line is connected to at least one of said at least two columns of antenna elements, and wherein said phase shifter causes a change of said beam in azimuth and operates in conjunction with another phase shifter controlling said microwave beam in elevation.

* * * * *